United States Patent [19]

Parkander

[11] Patent Number: 4,846,454

[45] Date of Patent: Jul. 11, 1989

[54] METHOD AND APPARATUS FOR FOLDING, STACKING AND SEPARATING CONTINUOUS FORMS IN A MOVING WEB

[75] Inventor: Göthe A. C. Parkander, Ljungby, Sweden

[73] Assignee: TH Stralfors AB, Ljungby, Sweden

[21] Appl. No.: 158,612

[22] Filed: Feb. 22, 1988

[51] Int. Cl.[4] ..... B41F 13/58

[52] U.S. Cl. ..... 270/5; 270/30; 270/39; 493/324; 493/357; 493/412

[58] Field of Search ..... 270/5, 30–31, 270/38–40, 21.1, 52.5; 493/320, 324, 357, 411, 412, 414

[56] References Cited

U.S. PATENT DOCUMENTS

| | | | |
|---|---|---|---|
| 3,937,452 | 2/1976 | Gäth | 270/39 |
| 4,054,283 | 10/1977 | Rayfield | 493/412 |
| 4,358,285 | 11/1982 | Fujio | 493/412 |
| 4,718,654 | 1/1988 | Ehlers | 270/52.2 |
| 4,730,762 | 3/1988 | Felix | 270/39 |

FOREIGN PATENT DOCUMENTS

| | | | |
|---|---|---|---|
| 66456 | 5/1980 | Japan | 493/411 |
| 119659 | 9/1980 | Japan | 493/411 |
| 183467 | 9/1985 | Japan | 270/39 |

*Primary Examiner*—Robert E. Garrett
*Assistant Examiner*—Therese M. Newholm
*Attorney, Agent, or Firm*—Tilton, Fallon, Lungmus & Chestnut

[57] ABSTRACT

A method and machine for folding, stacking and separating continuous forms in a moving web, the continuous forms web being prefabricated with regard to width, margin line holes and transverse perforations intended for zigzag folding of the web to form it into a stack after it has been provided with print in a printer having a supply of series of preferably personalized forms, wherein each series includes an initial form marked with an address and optionally with a separation mark a first system having feed means for the web which cooperation with the line holes advance the web in controlled register, and means for cutting the web on electronic command from a sensor which reacts to the separation mark or, alternatively, on electronic command from the printer, and a second system comprising a driven feed device for advancing the web and a swinging waddling device, the web passing through the waddling device and being formed during the swinging movements thereof into a zigzag folded stack, and further means for squeezing and holding down the folded stack.

11 Claims, 6 Drawing Sheets

METHOD AND APPARATUS FOR FOLDING, STACKING AND SEPARATING CONTINUOUS FORMS IN A MOVING WEB

BACKGROUND AND SUMMARY OF INVENTION

This invention relates to apparatus and method for folding, stacking and separating continuous forms in a moving web and, more particularly, continuous forms which have been prefabricated with regard to width, margin line holes and transverse perforations intended for zigzag folding of the web to form it into a stack after it has been printed in a printer having a supply of series of preferably personalized forms, wherein each series includes an initial form marked with an address and optionally with a separation mark.

In printing all kinds of information on a moving web of continuous forms, such as messages, wage statements, invoices, etc., the printout with current technique takes place in high-speed printers of the "impact" or preferably laser type. The printer is controlled by a computer with memory that contains all data required. The endless web of forms runs through the printer under automatic control of the feed simultaneously as printing is effected. The printing speed is high, which also means that the web advances at high speed.

The web is usually wound as a roll onto a bobbin which may be mounted on a shaft in a roll stand from which the web is fed, continuously or intermittently, into the printer. The roll stand operates as an independent unit and has drive and control means of its own, including, among other things, a depending loop of the web which is sensed by means of a photo-electric cell, so that the tension of the web when fed into the printer practically equals zero. The same applies to the output side of the printer.

Before being rolled onto the bobbin, the web is also prefabricated with regard to width, margin line holes, perforations and preprint, if desired. These preparatory operations are carried out in separate machinery, usually referred to as presses. Thereafter, the web roll is delivered to the data processing center fully ready for printing and the roll may be of jumbo size with a diameter of up to 1250 mm.

As for the perforations of the web it should be observed that a transverse perforation is always located at a separating line between two sheets (or form lengths) so that the web can be either folded or torn off along the perforation. Other perforations may also be arranged in each separate form, e.g., for tearing off a counterfoil, a payment notice or the like.

After the passage through the printer, various expedients have been tried out to ascertain the simplest and most rational way of taking care of the printed forms.

By the folds/perforations the web is fully prepared for the folding of the forms into a stack. Some printers are also equipped with a built-in folding and stacking device. However, the ever higher printing speeds, particularly in modern laser printers, with the attendant great web lengths per unit of time, mean that such an expedient is unsatisfactory, the more so as further demands are placed on the processing procedure.

Development in the art has resulted in a system where all after-processing of the printed web takes place outside the printer in separate machines. According to a prior art method, it is thus necessary to prefold the web in a machine before the final folding, stacking and simultaneous so-called job separation can be performed in another machine. Job separation implies that a division of the web is effected by cutting or tearing a web at a transverse perforation between two jobs. A job is defined as a number of forms having common characteristics, for instance the same text, the same customer, the same order number or the like. At the final folding/-stacking with job separation it is also previously known to insert a tab in the stack where separation has been made to permit later separation of the jobs from one another in a simple manner.

Recently, the market has raised a further important demand under the term "first page up". Obviously, it is justified to require not only that the jobs in a stack shall be separated from one another but also that each job shall be rapidly and positively identifiable. For that purpose, the first page of each job is printed with a distinct address or other suitable marking which is included from the very outset in the printing program.

In the prior art folding and stacking technique there is a 50% risk that the page or sheet bearing the address, which for natural reasons is the first sheet of each job, will lie at the bottom of the job and with the printed face turned inwardly toward the other sheets of the job.

After inverting the stack, it is therefore necessary first to turn over the first sheet before the address can be read. This is very inconvenient. Besides, an essential disadvantage of the existing technique with regard to folding and stacking is the already-mentioned fact that separate process operations are required for prefolding and folding/stacking, respectively, with attendant demands for manual intervention and space etc.

One object of the present invention is to eliminate the inconveniences of existing technique and to provide machine wherein the prefolding operation and the contemplated unit therefor are dispensed with.

Another object of the invention is to provide the so-called "first page up" function in the machine.

According to the invention, the prefolding operation and the contemplated unit therefor are dispensed within that the machine presents cooperating means for advancing the web, for alternately changing web direction incident to folding, holding down the folded web and stack removal.

According to the invention, the so-called "first page up" function is attained with the aid of a method and machine for selectively changing the orientation of the means for directing the web into the folded stack.

The invention will be described more in detail in the following specification with reference to the accompanying drawing, in which.

DETAILED DESCRIPTION

Figure 1:
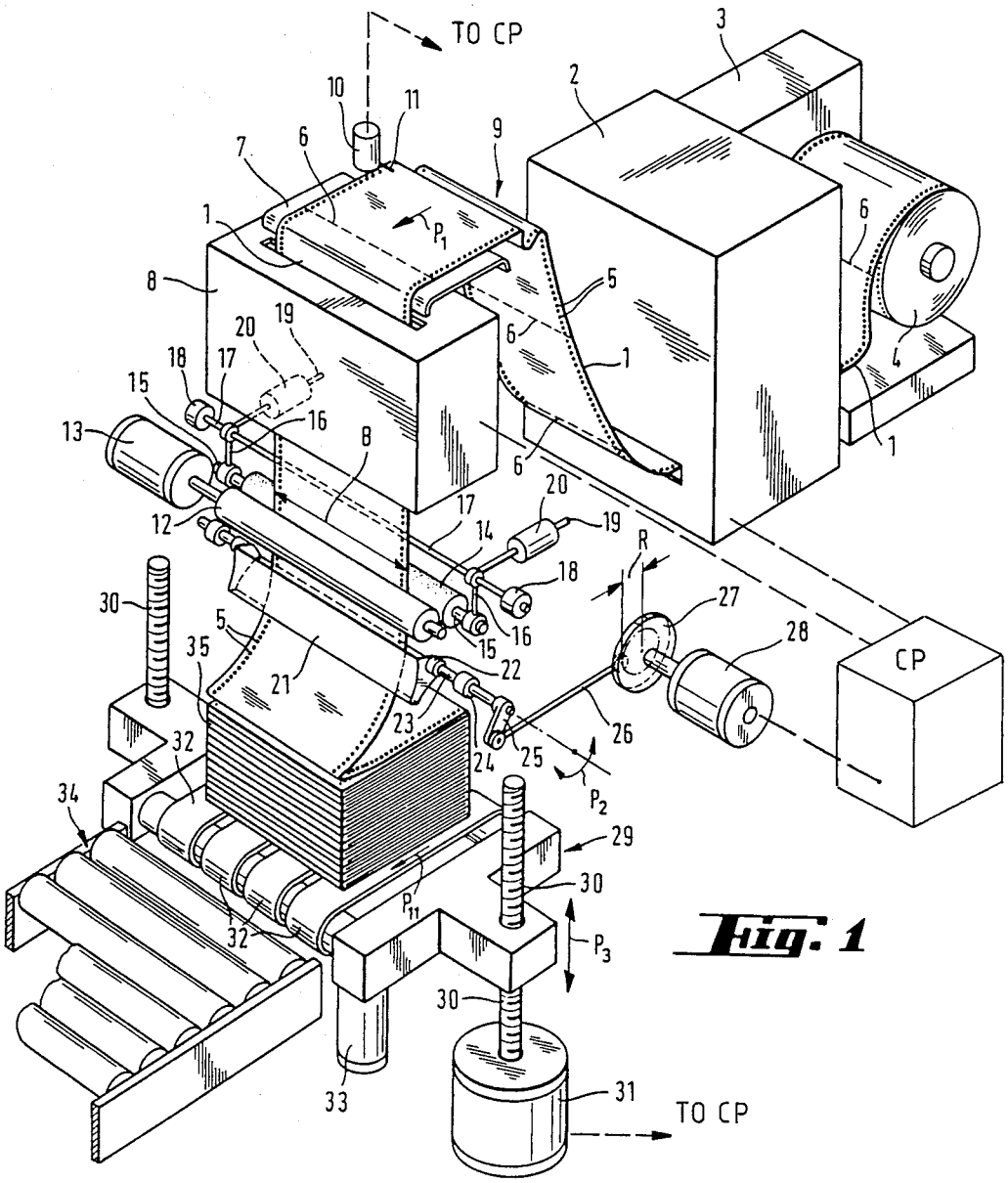
FIG. 1 is a perspective partially schematic view of the main components of a folding, stacking and separating machine according to the invention; for greater clarity, some constituent parts have been omitted from this FIG. but are, instead, shown in subsequent FIGS.

In FIG. 1, a web of continuous forms 1 is run through a printer 2 from a roll 4 mounted in a roll stand 3. The web of forms has been prefabricated with regard to width B (see the right central portion of FIG. 1) line holes 5 and transverse perforations 6. The forms of the web may also have imprints thereon, such as logotypes or the like.

The web 1 is pulled in the direction of the arrow $P_1$ over a supporting plate 7 through a housing 8 which houses means (not shown) in conformity with well-known technique, such as two pin-belt tractors for feeding the web via the line holes 5, guides for the web and a transverse severing system for cutting the web on job separation. Before passing over the supporting plate 7, the web 1 moves in a zigzag formation through the former 9 brought about by the device shown in FIG. 2, which is described more in detail later.

For the cutting of the web 1, which always occurs along a predetermined transverse perforation 6, there is provided a sensor 10 arranged in fixed, but adjustable connection with the housing 8, and a separation or cutting mark 11 applied to the web 1 simultaneously with the printing in conformity with previously established programming.

An alternative way of giving the command to cut the web is by a signal from the printer 2, in which case the printer automatically counts the number of forms or the number of length units of the web that the respective job comprises, and then sends a cutting signal to the transverse severing means.

The housing 8 with the means connected with and built into it is mounted in a frame (not shown) which may also contain the electronic apparatus necessary for the control of the machine, such as computers, etc. It will be appreciated that in accordance with conventional practice in converting machinery, side frames suitably rigidified by cross members support the various rolls, shafts, housings, etc. These have been omitted for clarity of presentation.

On the frame there is mounted below the housing 8 a feed mechanism for advancing the web 1 along a predetermined path. The feed mechanism preferably includes a feed roll 12 driven by a motor 13 and an idler or counter-pressure roll 14 cooperating with the feed roll 12. As is apparent from FIG. 1, the web 1 runs between the two rolls 12, 14. Further, in connection with the rolls 12, 14 there are arranged guides for the web, which will be described more in detail later, with reference to FIG. 4.

The counter-pressure roll 14 is movably mounted so that it always exerts pressure against the feed roll 12, whereby the web is squeezed under a certain pressure between the rolls 12, 14. In the embodiment of FIG. 1, the roll 14 is arranged for rotation on a shaft 15 which is supported by two arms 16 disposed on a shaft 17 which is mounted in two bearings 18 so as to permit rotation of shaft 17. At right angles to each arm 16 and in fixed connection therewith extends a second arm 19 which has a weight 20 movably mounted thereon to produce a suitable bearing pressure of the counter-pressure roll 14 against the feed roll 12.

An oscillating chute or waddling device 21 is disposed directly beneath the rolls 12, 14. The device 21 includes two blades which are slightly inclined relative to one another leaving a gap therebetween which tapers downwardly and through which the web 1 passes. The two blades of the waddling device 21 are interconnected at their end portions by means of hubs 22 disposed on both sides thereof. One of the hubs 22 is mounted on shaft 23 which, in turn, is mounted in bearing 24. A crank 25 is fixed to shaft 23. A reciprocating movement, as indicated by the double arrow $P_2$, is brought about by the crank 25, a connecting rod 26 and a crank eccentric 27 which is driven by a first stepping motor 28. The amplitude of swing of the lower portion of the waddling device 21 can be selected by setting a crank radius R on the crank eccentric 26.

The swinging movement for the waddling device 21 is transmitted from the stepping motor 28 in sinusoidal form, a crank radius (R, FIG. 1) being adjustable for variation of the swinging movement of the waddling device which also swings in phase with the feeding of the web.

A stacking table 29 is disposed beneath the waddling device 21 and is adapted to be raised or lowered as indicated by the double arrow $P_3$, the raising and lowering movements being brought about by a threaded spindle 30 to which a second stepping motor 31 is coupled so as to drive the spindle 30. Moreover, the stacking table 29 is equipped with conveyor belts 32 driven by a motor 33.

In a chosen direction of discharge and in direct connection with the stacking table 29 there is also arranged a transport line 34 for carrying away finished stacks 35.

Fold Promoting Mechanism

Figure 2:
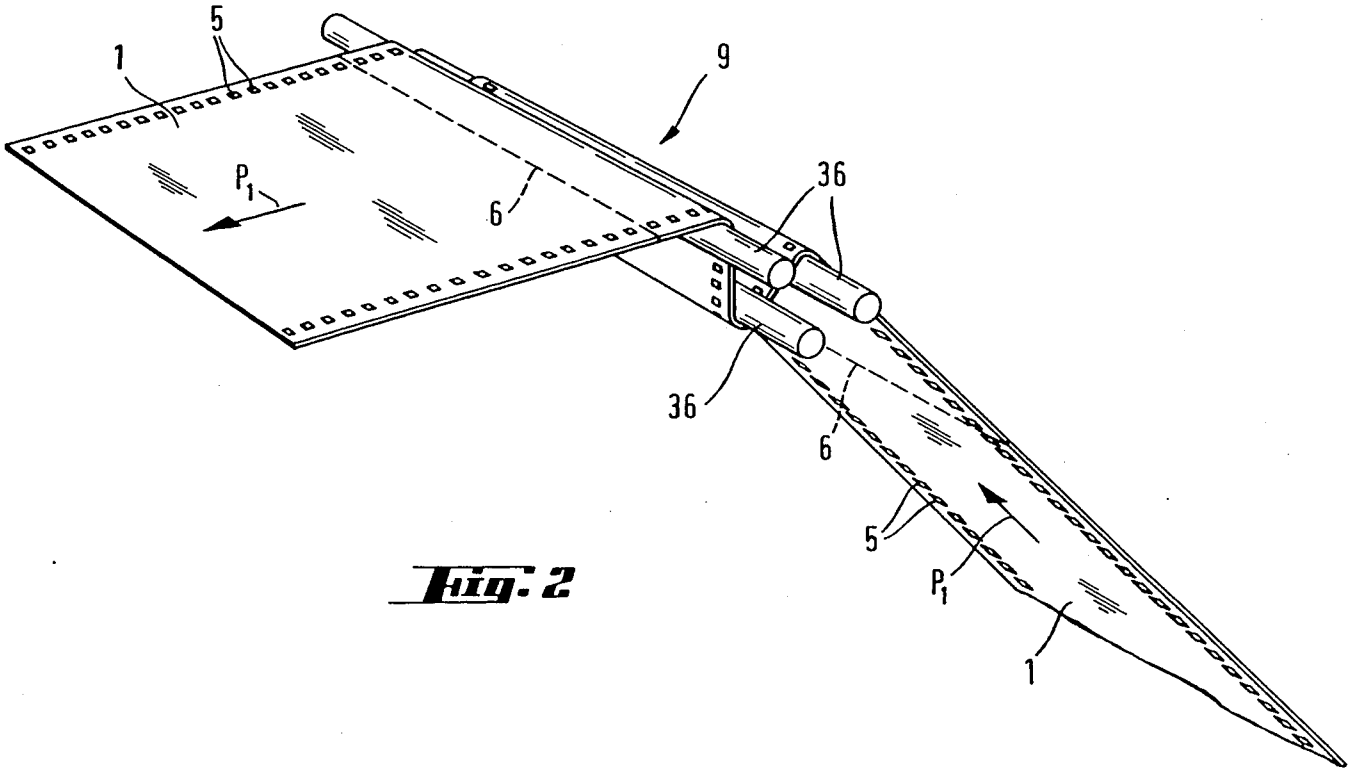
FIG. 2 is a fragmentary perspective view of devices for folding a web of continuous forms in three steps at perforations therein prior to feeding of the web into the machine shown in FIG. 1.

It has already been mentioned that a general zigzag formation via former 9 of the web occurs in conjunction with the passage thereof over the supporting plate 7 (FIG. 1). FIG. 2 shows an arrangement suitable for producing that effect. A number of rods 36, preferably three in number as shown in FIG. 2, are fixedly but adjustably mounted in connection with the machine frame or the supporting plate 7. The web 1 runs respectively over and under the rods 36 and is thereby subjected, on the one hand, to a certain braking force which stretches the web and, on the other hand, to bending which results in softening the transverse perforations to some extend, which in turn facilitates the subsequent folding and forming of the web into the stack 35.

Fold Hold-Down Mechanism

Figure 3:
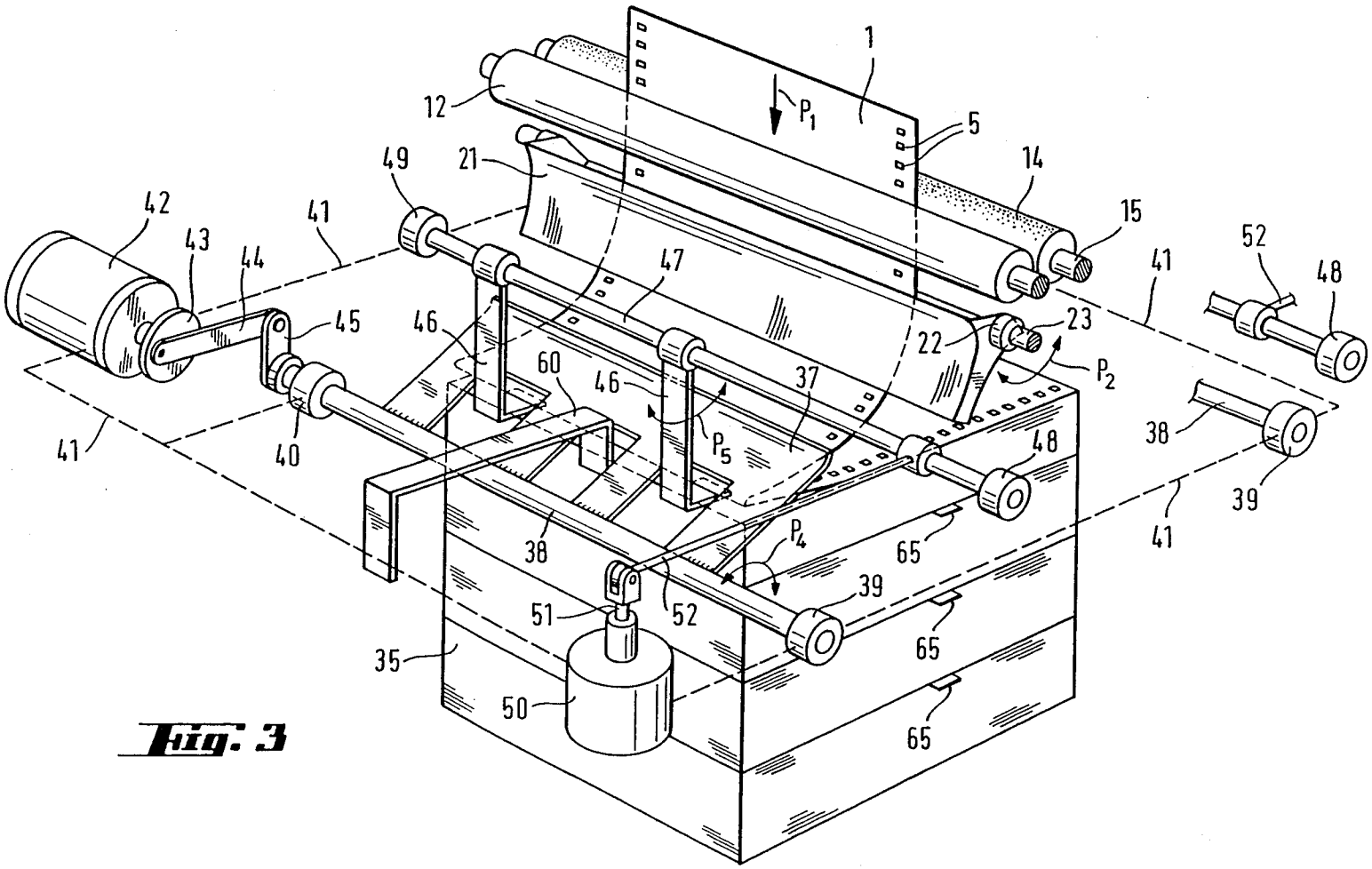
FIG. 3 is a fragmentary perspective view of a special squeezing blade and hold-down hooks for holding down a folded and squeezed edge of a stack of the folded web of forms.

To achieve effective and reliable folding, stacking and separation of the web 1, there are provided further devices which are not illustrated in FIG. 1 but which, for greater clarity, are shown in FIG. 3 where the same reference numerals are used as in FIG. 1 with regard to the feed roll 12, the counter-pressure roll 14, the waddling device 21 and the folded stack 35. An advantageous condition for efficient folding and stacking is that, after being laid out from the waddling device 21, each fold crease will be substantially squeezed and that the stack is kept compressed during folding. For it is in the nature of things that a web of continuous forms, which is formed into a stack by folding, always has a built-in tendency of springing back.

In FIG. 3, a squeezing blade 37 is disposed in the path of travel of the web from the waddling device 21 and above the front and rear fold creases of the stack 35. It should be noted that this arrangement is only shown at the forward or exiting fold edge of the stack in FIG. 3. However, the squeezing blade arrangements are identically the same at both fold edges (see FIGS. 5–8), but reversed in relation to one another. The squeezing blade 37 is fixed to a shaft 38 supported in two bearings 39,40 which are fixedly, but adjustably connected to a schematically-depicted framework 41 enclosing the entire folding system. In FIG. 3, the framework 41 is indicated by broken lines. The framework is fixedly installed in the above mentioned frame (not shown) of the machine.

Furthermore, there is fixedly connected to the framework 41 a third stepping motor 42 equipped with a crank eccentric 43 and a connecting rod 44 which transmits an oscillating movement to an arm 45 which is fixedly, but adjustably, mounted on the shaft 38. When the stepping motor 42 operates, the squeezing blade 37 provides up and down movement as indicated by the double arrow $P_4$ which results in squeezing of a fold crease and compression of the stack 35.

To prevent the stack springing back when the squeezing blade 37 returns in an upward direction, hold down hooks 46 are provided on a shaft 47 mounted in two bearings 48, 49 which in turn, are mounted on the framework 41 by means of a fixed, but adjustable connection. The hold-down hooks are actuated for outward and inward movement according to the double arrow $P_5$ by a solenoid 50 or like means via arms 51, 52. Both the squeezing blades 37 and the hold-down hooks 46 are adapted to be driven in phase with the web feed.

Web Stack Guide Means

Figure 4:
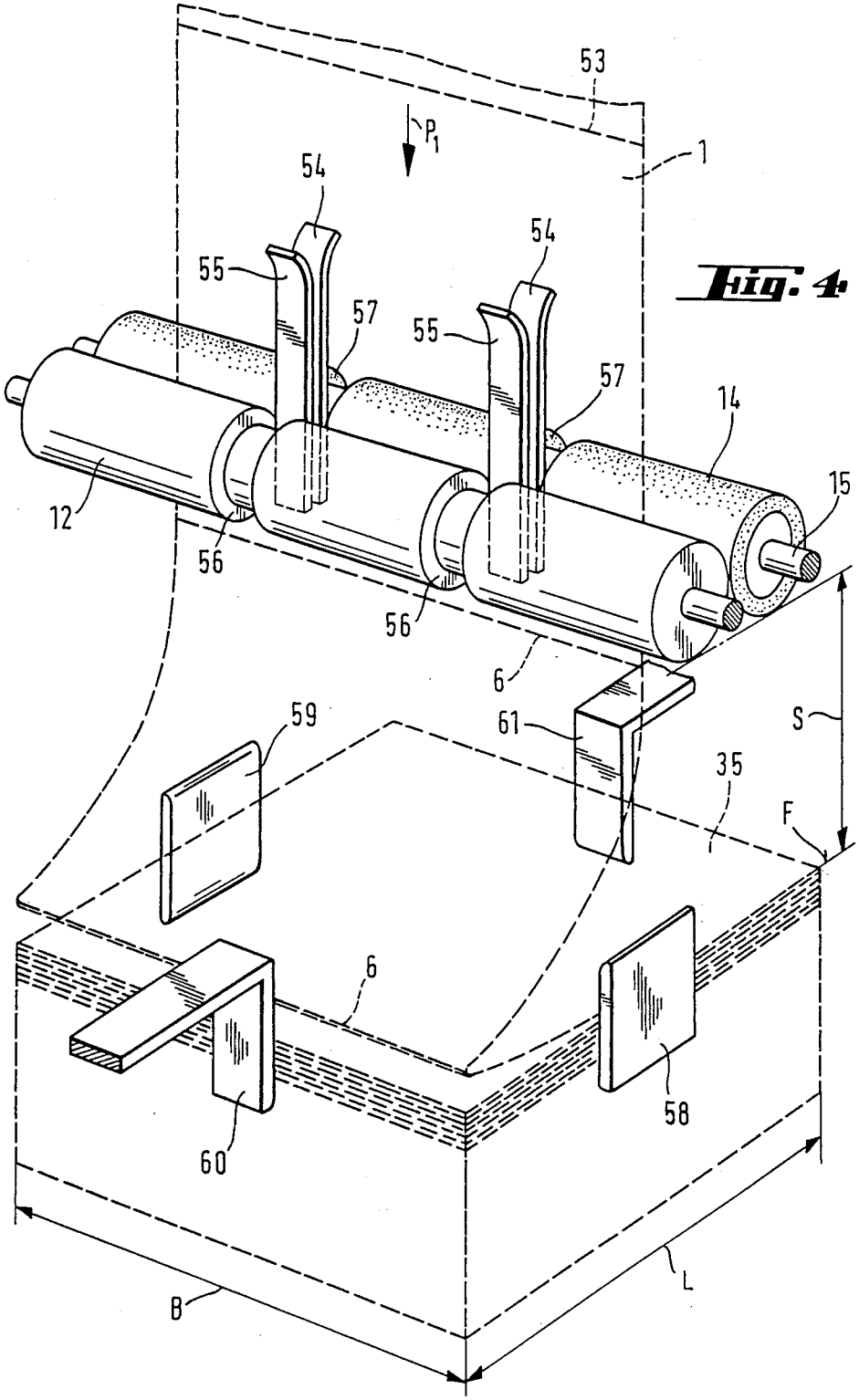
FIG. 4 is a fragmentary perspective view of two discharge rolls having two pairs of web guides for the web of forms.

FIG. 4 shows further devices which form part of the folding and stacking system according to FIG. 1 but which, for greater clarity, are illustrated separately. To ensure reliable guidance of the web of forms 1 in between the feed roll 12 and the counter-pressure roll 14, especially when the web 1 has been separated by a cut 53, pairs of guides 54, 55 are provided. Their upper portions are bent outwardly in wedge or trough shape while their lower portions extend downwardly between the rolls 12, 14 in grooves 56, 57. It should be added that the feed roll 12 is preferably of steel with brightly ground surface and that the roll 14 suitably is rubber-coated.

To ensure that folding is always carried out in correct position two lateral guides 58, 59 and two fold guides 60, 61 are mounted on the framework 41 around the upper part of the stack 35, as shown in FIG. 4. The guides 58–61 are fixedly but adjustably mounted on the framework 41.

The positions of the guides are determined by the shape or format of the form, i.e. the stack; the format being indicated in FIG. 4 by width measure B and length measure L corresponding to the form length. As a rule, one of the lateral guides 58, 59 is fixedly arranged while the other is adaptable to the width B, which also is the width of the web. As a result, one edge of the web is fixed in one and the same position. A similar procedure is used for the other units of the installation, such as roll stand and printer, whereby the adaptation to a modified web width is limited to one edge of the web only.

Operation

A description of the operation of the machine will now be given with reference to FIGS. 1–4 already described and FIGS. 5–8 which in schematic elevation show the various steps of the feeding, folding, cutting and job separation of the web. The same reference numerals as before are employed for the constituent parts of the machine. It is presupposed that in conformity with prior art the web of forms 1 runs without tension from the roll stand 3 (which carries the roll 4) through the printer 2 down into the housing 8 (FIG. 1) in which, as already mentioned, pin belt tractors engaging the line holes 5 advance the web The housing 8 is also interconnected to the framework 41 as is the zig-zag former 9. It is further presupposed that the requisite settings for the form shape have been made, i.e., proper positions of the lateral guides 58, 59 and the fold guides 60, 61 (FIG. 4). With the aid of setting means (not shown) all of these positional adjustments regarding the form, shape or format can be carried out from a common control panel via electric and electronic means according to prior-art technique.

It has been indicated above that all machine components which by way of various movements cooperate at the conversion process via stepping motors or the like, are electronically controlled by program input in computer memories, duly adapted to various contemporary formats etc. of the web of forms 1. The control panel CP (see FIG. 1) is designed as a central control unit common to all control commands. From the control unit all primary settings can be effected for a web of forms to be converted. Usually, the machine is put up, as diagrammatically shown in FIG. 1, in direct association with the printer 2 including the roll stand 3. This might imply that the folding, etc. machine cannot operate fully independently. For even though a given web length can be stored with the aid of prior art devices (not shown) between the printer and the machine, the input of the machine on continuous operation will depend upon the output of the printer. Electronic connection with start/stop signals is therefore established between the two units. A corresponding arrangement has also been provided between the printer 2 and the roll stand 3.

It should, however, be pointed out that the machine can also operate fully independently, for instance on conversions of a web which is supplied from an already folded stack or directly from a roll in a roll stand.

When starting with a fresh web to be converted into a stack including job separation, if any, the stacking table 29 (FIG. 1) is raised to an upper position adapted to a fold level F (FIG. 4). The fold level F always is one and the same and lies within a space S extending largely from the undersides of the rolls 12, 14 to the plane where folding takes place. As folding occurs and the stack 35 increases, the stacking table 29 is automatically lowered so that the fold level F always remains constant.

Furthermore, on insertion of a fresh web the machine is set in starting position through a push-button function on the control panel. This assumes that the fold level F for the stacking table 29 has been set, as well as the starting position for all fixed and movable means that take part in the process.

On insertion of a fresh web of forms in the machine the leading end of the web in a given constant starting position is disposed on the pin-belt tractors in the housing 8. The starting position is marked in the housing and corresponds to the initial position of the other means in the machine. In this manner, the web is brought in correct register, which in turn means that the transverse perforations 6 are always advanced to the correct position for folding (FIGS. 1 and 6).

Figure 5:
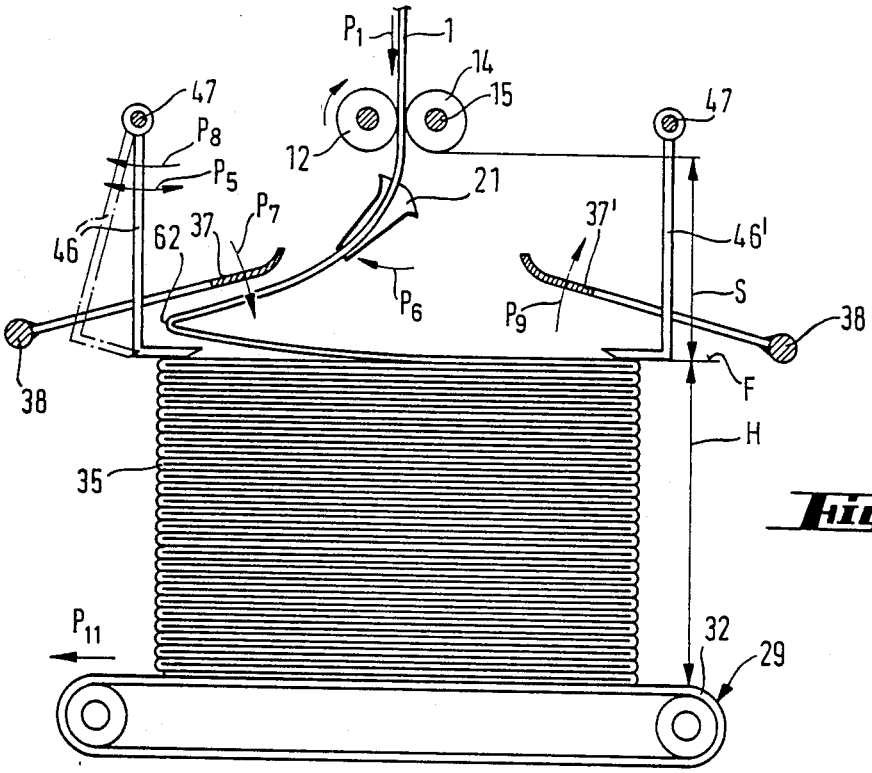
FIGS. 5 to 8 are schematic elevational views showing the sequence of steps of the web folding operation and a web separating operation, respectively.
Figure 6:
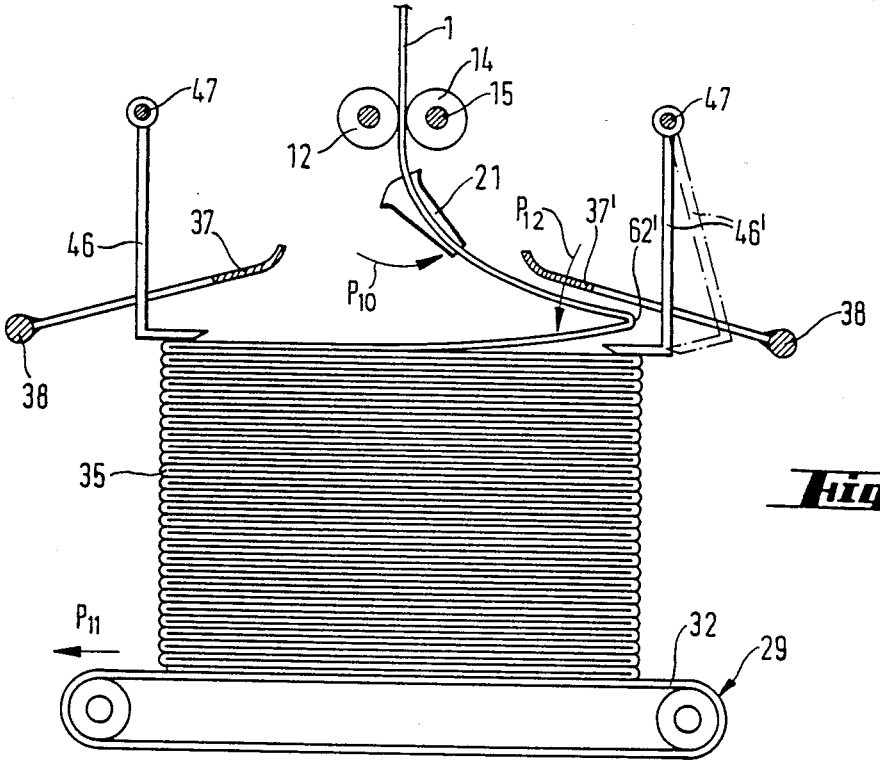

At the start of the machine for subsequent continuous operation the web is fed downwards while being folded and stacked according to FIGS. 5 and 6. It is presupposed in these FIGS. that the stack during folding has reached a certain height H, the stacking table 29 having been automatically lowered in small steps little by little through a distance H (FIG. 5) by the action of the second stepping motor 31. In the operating phase according to FIG. 5, the waddling device 21 by the action of the first stepping motor 28 (FIG. 1) has swung over as shown by the arrow $P_6$ to an outer position, simultaneously as the web 1 has been fed downwards so large a distance that a transverse perforation 62 lies flush with one edge of the stack 35 and the squeezing blade 37 (see also FIG. 3) is in an upper position but on its way down as shown by the arrow $P_7$ while the hold-down hooks 46 are in a position engaging the stack to keep the already placed fold creases pressed down.

A moment later, the squeezing blade 37 has moved down toward the fold 62 as indicated by the arrow $P_7$, simultaneously as the hold-down hooks 46 swing out as indicated by the arrow $P_8$, leaving the newly applied fold crease 62 free for squeezing. In this fashion, the stack 35 is also compressed again after the spring back that occurs when the hold-down hooks 46 let go of the edge of the stack 35.

At the right hand edge of the stack 35 (see FIG. 5), the corresponding hold-down hooks 46' are in a position of rest above the right-hand edge of the stack 35 simultaneously as a squeezing blade 37' is about to be raised as indicated by the arrow $P_9$ so that the next following folding operation at the right hand edge can be brought about in the manner shown in FIG. 6. The waddling device 21 has then swung over from the left hand to the right hand edge according to the arrow $P_{10}$ into a new outer position. During this movement the left hand fold previously made has been retained in position first by the squeezing blade 37 and then by the hold-down hook 46 which has swung over from an outer position shown in FIG. 5 to an inner position indicated in FIG. 6. Exactly the same folding and squeezing procedure as that described above for the left hand edge of the stack 35 now takes place for the right hand edge. When a perforation 62' has been advanced to the right hand edge of the stack the squeezing blade 37' is lowered (as indicated by the arrow $P_{12}$), the hold down hooks 46, move out and the waddling device 21 turns into a direction opposite to that indicated by arrow $P_{10}$.

The feed rate of the web of forms 1 is adapted to the printing speed of the printer, and the operation described is thus repeated alternately at the left-hand and right-hand edges of the stack, respectively. As earlier mentioned, the stacking table 29 is simultaneously lowered stepwise and automatically so that the fold level F (FIG. 5) is maintained all the time.

If the stack includes a full job or is part of a large job taking up several stacks, no job separation of the stack need be made. However, the subsequent processing, such as manual packaging in cartons, involves a limitation of the total stack height H to usually 250 mm. When such a maximum height of the stack, which is optional, has been reached, the operation of the machine is automatically stopped and cutting of the web occurs along a perforation by means of a prior-art cutting means disposed in the housing 8.

After the cutting operation to be described more in detail below, the stack is released entirely from the web. To release the stack also from the hold down hooks 46 and the lateral guides 58, 59 as well as from the fold guides 60, 61 (FIG. 4) the stacking table 29 is automatically lowered a suitable distance so as to lie flush with the discharge table 34 (FIG. 1). The conveyor belts 32 are then started in the direction of the arrow $P_{11}$ (see FIG. 1) via the motor 33 which continues driving until the stack 35 has been completely transferred to the discharge conveyor table 34.

The stacking table then automatically moves up to the fold level F (FIG. 5). During this stack discharge operation the machine has otherwise been stopped but it automatically starts up again when the stacking table has reached the fold level F.

As already mentioned, cutting of the web takes place by a cutting means (not shown) of known design, which is disposed in the housing 8. Cutting requires that the web feed be stopped for a short time (about 0.3 seconds). After cutting the web feed starts up again. It should be noted that the trailing or lower cutoff web portion is advanced somewhat more rapidly, about 5%, than the leading or upper cutoff web portion (i.e., of the web forming the subsequent stack) because the peripheral speed of the feed roll 12 has been adapted to provide this overfeed. It should further be noted that the feed roll 12 rotates all the time, i.e., also during the short stop for cutting of the web, which implies that the feed of the lower cutoff web portion starts up again as soon as cutting has been accomplished. The slack loop between the printer 2 and former 9 accommodates this slight delay.

Figure 7:
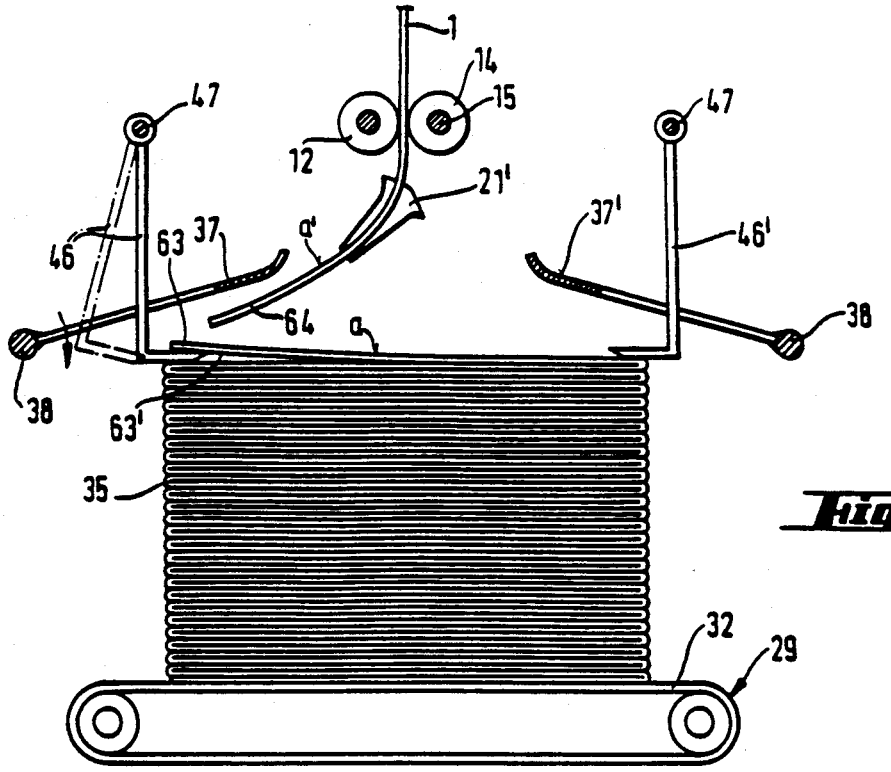

The positions of the web portions shortly after cutting are diagrammatically shown in FIG. 7. Here, the lower cutoff web portion 63 has been fed down onto the stack 35 or, alternatively, directly onto the stacking table 29, in position for squeezing by means of the squeezing blade 37. At the same time, the upper cutoff web portion 64 is advanced to a position determined by the cutting mark or, alternatively, by a signal from the computer, whereupon squeezing occurs immediately by means of the squeezing blade 37. Then folding proceeds continuously in the manner set forth above. What has been stated here about cutting at finished stack also applies to job separation within the stack, with the important addendum, however, that as a rule the "first page up" function, here abbreviated as FPU, is a requirement.

Figure 8:
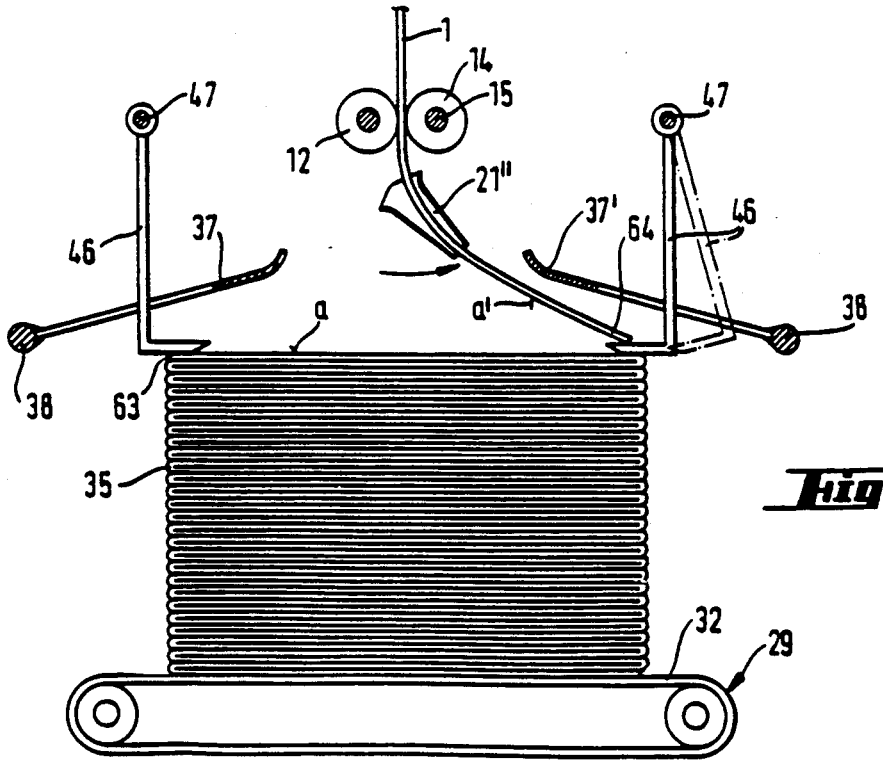

According to the invention, the FPU function is realized in a very simple and unique manner that cannot, with 100% certainty, be brought about by any other known folding machine available on the market. The procedure is illustrated in FIGS. 7 and 8. In FIG. 7, the lower cutoff web portion 63 has been advanced to squeezing position. The upper cutoff web portion 64 is being discharged through the waddling device 21. The printed text areas on the web portions are marked a and a', respectively. The problem now is to turn the web over so that the printed text area a' of the web portion 64 will be facing downwardly so that FPU is attained.

This is brought about according to FIG. 8 in that during the downward feed of the upper web portion 64, the waddling device 21 swings to the right in FIG. 8 whereupon the web portion 64 is pressed down by the squeezing blade 37'. The FPU function will be accomplished in this simple manner merely by means of a programming measure in the control program of the machine without any further interventions whatever. This procedure may be summarized as follows: After a lower cutoff web portion 63 has moved up to a squeezing position (63', FIG. 7) the waddling device 21 occupies a position (21', FIG. 7) in which it keeps an upper cutoff web portion 64 with a printed area a' directed upwardly and is controlled to swing to a position (21'', FIG. 8) in which it keeps the upper cutoff web portion 64 with the printed area a ' directed downwardly, whereby the web 1 is turned so that the printed area a' of the first page in the stack 35 faces outwardly or downwardly as shown. After subsequent inversion of the stack 35 the printed area a' of the first page 63 will thus be facing upwardly, which means that the "first page up" function is satisfied.

Summarizing the FPU operation, the waddling device 21 may or may not shift position at the conclusion of a stack, i.e., job. If the preceding stack, i.e., the one just completed, has an odd number of form lengths, the operation depicted in FIGS. 7 and 8 will be performed. There, the stack 35 will have its lower-most form length disposed so that the free leading edge thereof will be to the right. With printing on only one side, the lower-most form length will have its printed side facing downwardly. There, if the waddling device 21 remained in the FIG. 7 position, the leading web portion 64 of the succeeding stack would have its printed side facing upwardly. This has caused the heretofore unsoluble problem.

In normal practice in plants or offices using high speed printers, the stacks would be lifted off the receiving conveyor and inverted so as to position the lower-most form length uppermost. Again, normally, the first form length contains the earlier information, viz., title, introduction or initial chronological information. The inspector, in going through such a compilation of stacks will not be able to inspect the leading form length of a subsequent stack because its printed side is facing inwardly, i.e., downwardly after the manual inversion. So the inspector has to partially unfold the leading form length of this subsequent stack to determine its accuracy.

Of course, if all the stacks had an even number of form lengths, the initial lengths would all be facing properly. But this seldom occurs and it is a 50—50 chance that the initial length will be properly faced.

What the invention does is shortly after the slight halt in web feeding to accommodate cutting is to orient the web directing means, i.e., the waddling device 21 to the proper position. This is accomplished simply according to the instant invention—as illustrated, the proper position is always to the right. This is because the bottom-most form length (with its printed side down) has its free edge to the right. If the first stack has an uneven number of form lengths, the waddling device after directing the last panel or form length of a job will be directed to the left, as shown in FIG. 7. It is then moved to the right, as seen in FIG. 8.

On the other hand, with an even number of panels or form lengths in the initial stack, the waddling device in directing the trailing form length 63 will already be facing to the right, so no change has to be made. In other words, in the illustration given, the directing means in the form of the waddling device 21 is always oriented to the right position after directing the last panel 63. In other words, the chute constituting the waddling device 21 is always positioned at the same end of the oscillation path upon start of a subsequent stack.

This is readily and simply achieved by conventional control means, i.e., those embodied in the control panel CP. The control panel CP also includes the usual electric and electronic components such as transformers, rectifiers, computer with memory, etc. as well as a suitable computer program for actuating the stepping motors (28 for the waddling device 21, 31 for the stacking table 29, and 42 for the squeezing blades 37, 37'), the solenoid 50 and 42 for the hold-down hooks 46, 46, and motor 33 for the conveyor belts 32. It also is electrically coupled to the housing 8 for controlling web advance and cutoff. This is triggered, as mentioned before, by a signal from the sensor 10 or a signal from the printer 2 and the brief cessation of web advance to permit transverse severance is accommodated by the slack loop between the printer 9 and the zig-zag former 9.

Thus, the command or signal for job separation stems from the printer 2 which either applies the separation or cutting mark 11 (see FIG. 1) to be detected by the sensor 10 or transmits the signal to the control panel CP for determining the end of a job.

Equally advantageous is the ability of the inventive apparatus to handle unprefolded webs. In the past, a web stack was positioned adjacent the printer 2 for supplying the form lengths, viz., in the place of the roll 4. With the high speeds attainable by the laser printers, providing a continuous supply of stacks became a serious problem so the art went to web rolls. These, of course, were not prefolded, i.e., uncreased, so the prior art folding, stacking and separating devices worked under a handicap—usually having to provide some prefolding operating after the printer with the attendant drawbacks pointed out hereinbefore. This has all been solved by the instant invention, particularly through the use of the perforation softening former 9 and squeezing and hold-down means 37, 46 so that an integrated in-line operation is achieved.

Job separation with FPU does not affect folding or stacking in other respects. In some cases, it is desirable to mark each separated job with a tab 65 (FIG. 3) which is automatically inserted in the stack in conjunction with the separation. Such tab inserting assemblies belong to conventional technique and have not been shown in the drawings An important feature of the described machine is that it is capable, by reason of its unique function and design, of carrying out a folding operation and job separation directly from a web of forms that has not been prefolded beforehand. As already mentioned, this has not been possible earlier. Instead, two separate units were needed: a first machine for prefolding, usually with storage device for the prefolded web directly connected to it, and a second machine for final folding, stacking and job separation. According to the invention, one and the same machines replaces two hitherto necessary production units, which implies lower investment costs, lesser floor space and simpler handling and maintenance.

Furthermore, it has not hitherto been possible during the stacking operation to place the first page of the stack with its printed area facing outwardly, i.e., fully visible.

It is understood that the invention is not limited to the embodiment elucidated in the specification and pertaining drawings as modification are conceivable with the spirit and scope of the appended claims. Thus, for instance the control device may be designed in a manner other than that described and shown, and the directing means illustrated as the waddling device may be driven by means other than those described and shown, without departing from the inventive concept.

What is claimed is:

1. Apparatus for folding, stacking and separating continuous forms in a moving web, said continuous forms web being prefabricated with regard to width B), margin line holes (5) and transverse perforation 6) intended for zizag folding of the web (1) to form it into a stack (35) after it has been provided with print in a printer (2) having a supply of series of preferably personalized forms, wherein each series includes an initial form marked with an address and optionally with a separation mark (11), characterized by the fact that it comprises a first system (8) including feed means for the web (1) which in cooperation with the line holes (5) advance the web in controlled register, and means for cutting the web (1) on electronic command form a sensor (10) which reacts to one of the separation mark (11) and an electronic command from the printer (2), and a second system comprising a driven feed device (12-14) for advancing the web (1) and a swinging waddling device (21), said web passing through said waddling device and being formed during the swinging movements thereof into a zigzag folded stack, further means for squeezing and holding down the folded stack (35) and a stacking table (29) on which the stack is built up all the means for feeding, folding, stacking and cutting the web being electronically controlled by a computer which usually also cooperates with a printer (2), as a rule directly connected to the apparatus, to produce corresponding start and stop signals, the swinging movement for the waddling device (21) being transmitted in sinusoidal form from said stepping motor (28) via a crank eccentric (27) and a crank (26), a crank radius (R) being adjustable for variation of the amplitude of swing of he waddling device which also swings in phase with the web feed.

2. Apparatus for folding, stacking and separating continuous forms in a moving web, said continuous forms web being prefabricated with regard to width (B), margin line holes (5) and transverse perforations (6) intended for zigzag folding of the web (1) to form it into a stack (35) after it has been provided with print in a printer (2) having a supply of series of preferably personalized forms, wherein each series includes an initial form marked with an address and optionally with a separation mark (11), characterized by the fact that it comprises a first system (8) including feed means for the web (i) which in cooperation with the line holes (5) advance the web in controlled register, and means for cutting the web (1) on electronic command from a sensor (10) which reacts one of the separation mark (11) and an electronic command from the printer (2), and a second system comprising a driven feed device (12–14) for advancing the web (1) and a swinging waddling device (21), said web passing through said waddling device and being formed during the swinging movements thereof into a zigzag folded stack, further means for squeezing and holding down the folded stack (35) and a staking table (29) on which the stack is built up all the means for feeding, folding, stacking and cutting the web being electronically controlled by a computer which usually also cooperates with a printer (2), as a rule directly connected to the apparatus, to produce corresponding start and stop signals, setting means being arranged for a setting position for form format in conjunction with the bearings for the squeezing blades (37), the hold-down hooks (46) and fixation points for the lateral guides (58, 59) and the fold guides (60, 61), said setting means being directed to fixed and predetermined positions via electronic signals through pushbutton functions from a control panel common to the entire apparatus.

3. Apparatus for folding, stacking and separating continuous forms in a running web, said continuous forms being prefabricated with regard to width (B), margin line holes (5) and transverse perforations (6) intended for zigzag folding of the web (1) to form it into a stack (35) after it has been provided with print in a printer (2) having a supply of series of preferably personalized forms, wherein each series includes an initial form marked with an address and optionally with a separation mark (11), characterized by the fact that it comprises a first system (8) having feed means for the web (1) which in conjunction with the line holes (5) advance the web in controlled register, and means for cutting the web (1) on electronic command from a sensor (1) which reacts to the separation mark (11), or, alternatively, on signals from the printer (2), and a second system comprising a driven feed device (12–14) for advancing the web (1), and a swinging waddling device (21), said web passing through the waddling device and being formed during the swinging movements thereof into a zigzag folded stack, further means for squeezing and holding down the folded stack (35), and a stacking table (29) on which the stack is built up, all of said means for feeding, folding, stacking and cutting the web being electronically controlled by a computer which usually also cooperates with a printer (2), as a rule directly connected to the apparatus, to produce corresponding start and stop signals; and after a lower cutoff web portion (63) proceeds to a squeezing position (63) said waddling device (21) occupies a position (21) in which it keeps an upper cutoff web portion (64) with a printed area (a') directed upwardly and is controlled to swing to a position 21') in which it keeps the upper cutoff web portion (64) with the printed area (a') directed downwardly, whereby the web (1) is turned so that the printed area (a') of the first page in the stack (35) faces outwardly.

4. Apparatus for folding, stacking and separating continuous forms in a single moving web comprising a frame, means on said frame for advancing said web along a predetermined path, cutting means in said path upstream of said advancing means for transversely severing said web to define discrete jobs of zig-zag folded form lengths, oscillatory web directing means on said framework in said path downstream of said advancing means for alternately changing the direction of successive form lengths to develop a zig-zag folded stack constituting a job, and control panel means operably associated with said framework interconnected with said cutting means, advancing means and directing means for stopping the advance of said web thereafter transversely severing said web and thereafter orienting said directing means always at a first position at one extreme of the oscillation of said oscillatory directing means to provide a series of jobs wherein the initial form length of each job have their corresponding sides facing in the same direction.

5. The apparatus of claim 4 in which said oscillatory web directing means includes a chute and first stepping motor means on said framework eccentrically connected to said chute to move said chute between said first position and a second position at the other extreme of said oscillation.

6. The apparatus of claim 4 in which said framework is equipped with a zig-zag former in said path upstream of said cutting means for softening perforations in said web between each form length, and stack squeezing and hold-down means on said framework whereby said apparatus is adapted to zig-zag fold an unprefolded web from a web roll.

7. The apparatus of claim 6 in which said squeezing means includes oppose squeezing plates pivotally mounted on said frame work for movement in said path toward and away from the stack folded sides, third stepping motor means on said framework eccentrically connected to said squeezing plates for selectively pivoting the same upon signal from said control panel means, said hold-down means; including opposed hook means for pivotal movement into and away from said path to hold down the stack folded sides upon movement of said squeezing plates away from said stack folded sides, and solenoid means on said framework for selectively pivoting said hook means, stack table means reciprocably mounted on said framework in said path downstream of said squeezing and hold-down means, and second stepping motor means for moving said stack table means.

8. A method for folding, stacking and separating continuous form lengths in a single moving web comprising advancing said web along a predetermined path, zig-zag folding said web along equally-spaced lines of transverse perforation by alternately positioning oscillatory directing means in said path in first and second positions at the extremes of oscillatory movement of said directing means, severing said web along one of said lines of transverse perforation and after the trailing edge of the severed web has advanced past said directing means always orienting said directing means in said first position to provide a series of stacks wherein the initial form length of each stack have corresponding sides facing the same direction.

9. The method of claim 8 in which said web is printed with variable information on different form lengths, said information being on said corresponding sides and subsequently inverting said series of stacks to provide said information on the initial upwardly facing form length of each stack.

10. The method of claim 8 in which said web is unwound from a roll and prior to zig-zag folding is subjected to bending to soften said lines of transverse perforation.

11. A method of folding, stacking and separating a single web equipped with equally spaced lines of transverse perforation defining form lengths comprising the steps of unwinding said web from a source roll and advancing said web along a predetermined path in which said web is sequentially subjected to printing, softening along said perforation lines, zig-zag folding to form a stack, and alternate squeezing and holding down the developing folded edges portions of said stack, and intermittently severing said web along a perforation line to end one stack and commence another, said softening, squeezing and holding down steps cooperating to develop stacks of printed form lengths in an in-line operation without the need for pre-folding the web before zig-zag folding, said step of zig-zag folding including oscillating a chute means and, at the start of each stack always positioning said chute means at the same end of the oscillation path.

* * * * *